US009698543B2

(12) United States Patent
Kato et al.

(10) Patent No.: US 9,698,543 B2
(45) Date of Patent: Jul. 4, 2017

(54) FUSE-EQUIPPED CONNECTOR

(71) Applicant: YAZAKI CORPORATION, Tokyo (JP)

(72) Inventors: Hajime Kato, Shizuoka (JP); Seizi Adachi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/022,898

(22) PCT Filed: Oct. 17, 2014

(86) PCT No.: PCT/JP2014/077715
§ 371 (c)(1),
(2) Date: Mar. 17, 2016

(87) PCT Pub. No.: WO2015/056788
PCT Pub. Date: Apr. 23, 2015

(65) Prior Publication Data

US 2016/0233625 A1 Aug. 11, 2016

(30) Foreign Application Priority Data

Oct. 18, 2013 (JP) ..... 2013-217838

(51) Int. Cl.
*H01R 13/688* (2011.01)
*H01R 24/28* (2011.01)
(Continued)

(52) U.S. Cl.
CPC ..... *H01R 13/688* (2013.01); *H01R 13/502* (2013.01); *H01R 24/28* (2013.01);
(Continued)

(58) Field of Classification Search
CPC ..... H01R 13/6666; H01R 13/684
(Continued)

(56) References Cited

U.S. PATENT DOCUMENTS 7,748,117 B2 * 7/2010 Pizzi ..... H01H 69/02 264/272.15
8,425,256 B2 4/2013 Aoki et al.
(Continued)

FOREIGN PATENT DOCUMENTS

JP 2011-222398 A 11/2011
JP 2012-155943 A 8/2012
(Continued)

OTHER PUBLICATIONS

English language Written Opinion of the International Search Report for PCT/JP2014/077715 dated Jan. 13, 2015.
(Continued)

*Primary Examiner* — Abdullah Riyami
*Assistant Examiner* — Justin Kratt
(74) *Attorney, Agent, or Firm* — Kenealy Vaidya LLP

(57) ABSTRACT

A fuse-equipped connector (1) is configured in combination of a first connector (10) and a second connector (30) which can be assembled to each other in an attachable and detachable state. The first connector (10) includes a first terminal (13) electrically connected to an external apparatus (50) and a connection portion (12*a*) mechanically connectable to the external apparatus (50). The second connector (30) includes a second terminal (33) electrically connected to the first terminal (13) and a fuse (35) being electrically connected to the second terminal (33). In a state where the first connector (10) and the second connector (30) are assembled with each other, the first terminal (13) and the second terminal (33) are electrically connected to each other.

2 Claims, 9 Drawing Sheets

(51) Int. Cl.

| | |
|---|---|
| ***H01R 13/502*** | (2006.01) |
| *H01R 13/684* | (2011.01) |
| *H01R 13/66* | (2006.01) |
| *H01R 103/00* | (2006.01) |

(52) U.S. Cl.
CPC ..... *H01R 13/6666* (2013.01); *H01R 13/684* (2013.01); *H01R 2103/00* (2013.01)

(58) Field of Classification Search
USPC ..... 439/620.26
See application file for complete search history.

(56) References Cited

U.S. PATENT DOCUMENTS

| | | | | |
|---|---|---|---|---|
| 9,124,021 | B2 * | 9/2015 | Kashiwada ..... | H01R 13/512 |
| 2012/0094537 | A1 * | 4/2012 | Aoki ..... | H01R 13/688<br>439/620.26 |
| 2014/0162497 | A1 * | 6/2014 | Lim ..... | B60L 3/04<br>439/620.26 |

FOREIGN PATENT DOCUMENTS

| | | | |
|---|---|---|---|
| JP | 2012-182106 | A | 9/2012 |
| JP | 2012182106 | A * | 9/2012 |

OTHER PUBLICATIONS

International Search Report and Written Opinion of the International Search Report for PCT/JP2014/077715 dated Jan. 13, 2015.

* cited by examiner (a)

(b)

(a)

(b)

FUSE-EQUIPPED CONNECTOR

TECHNICAL FIELD

The present invention relates to a fuse-equipped connector.

BACKGROUND ART

In a fuse-equipped connector for supplying power to an external apparatus loaded in a vehicle, a technology for easily replacing a mounted fuse is suggested (Patent Literatures 1 and 2).

A fuse-equipped connector 100 of Patent Literature 1 illustrated in FIG. 8 includes a first and a second bus bar (terminals) 113 and 133 which are connected to input and output electric wires 114 and 134, a fuse 135 which conductively connects the first and the second bus bar 113 and 133 to each other to be fusible, and a housing (first housing) 112 which accommodates the first and the second bus bars 113 and 133 and the fuse 135. The first and the second bus bars 113 and 133 are inserted into an external apparatus 500, and are connected to a circuit in the external apparatus 500. The housing 112 includes a hood portion (connection portion) 112*a* which covers the periphery of an apparatus tab is fitted to a connector attaching hole of the external apparatus 500, and the fuse 135 is attached in an accommodation space in the hood portion 112*a*.

The accommodation space in the fuse-equipped connector 100 which accommodates the fuse 135 is formed in the hood portion 112*a* of the housing 112 which is fitted to the external apparatus 500. Therefore, when the housing 112 is detached from the external apparatus 500, the hood portion 112*a* becomes exposed, and attachment and detachment of the fuse 135 becomes possible. The fuse-equipped connector 100 is disclosed which can reduce the number of constituent components or improve reliability, and can improve shielding properties.

The fuse-equipped connector 100 of Patent Literature 2 illustrated in FIG. 9 includes the housing (first housing) 112. Constituent members similar to those in the fuse-equipped connector of the above-described Patent Literature 1 will be given the same reference numerals in the description. The housing 112 includes an opening portion (connection portion) 112*a* which is connected to the external apparatus 500, the fuse 135 which is accommodated in the opening portion 112*a*, and inverter connection terminals (a first bus bar and a second bus bar) 113 and 133. In addition, the housing 112 includes the input electric wire 114 and the output electric wire 134. The fuse-equipped connector 100 is screwed to the external apparatus 500 for preventing the occurrence of falling off. The fuse-equipped connector 100 is disclosed in which the fuse 135 can be replaced only by detaching the fuse-equipped connector 100 from the external apparatus 500, and the number of components, such as service covers or interlock circuits for the service covers can be reduced without an effort to detach the service cover.

CITATION LIST

Patent Literature

Patent Literature 1: JP-A-2011-222398

Patent Literature 2: JP-A-2012-155943

SUMMARY OF INVENTION

Technical Problem

However, in the configuration of the fuse-equipped connector 100 illustrated in Patent Literature 1 and Patent Literature 2, the input electric wire 114 and the output electric wire 134 are established in one housing 112. In other words, in the fuse-equipped connector 100, since the first bus bar 113, the second bus bar 133, the fuse 135, and the housing 112 are integrally formed, the number of input and output electric wires 114 and 134 which are connected to the fuse-equipped connector 100 provided with one housing 112 increases. Therefore, manufacturing becomes complicated, and handling or a maintenance operation becomes inconvenient.

In consideration of the above-described situation, an object of the present invention is to provide a fuse-equipped connector by which a fuse can be easily replaced.

Solution to Problem

The above-described object according to the present invention is achieved by the following configuration.

(1) A fuse-equipped connector which is configured in combination of a first connector and a second connector, in which the first connector includes a first terminal electrically connected to an external apparatus and a connection portion mechanically connectable to the external apparatus, the second connector includes a second terminal electrically connected to the first terminal and a fuse being electrically connected to the second terminal, and the first connector and the second connector can be assembled to each other in an attachable and detachable state, and the first terminal and the second terminal are electrically connected to each other in an assembled state.

(2) The fuse-equipped connector according to the above-described configuration (1), in which the fuse is exposed from an attachment portion to the first connector in the second connector when the second connector is detached from the first connector.

(3) The fuse-equipped connector according to the above-described configuration (2), in which at least one conductive member which configures the second terminal protrudes from the attachment portion, and the conductive member directly contacts at least one terminal provided in the first connector when the first connector is assembled to the second connector.

According to the fuse-equipped connector of the above-described configuration (1), since the first connector and the second connector can be assembled to each other in the attachable and detachable state, a maintenance operation, such as replacement of the fuse, is easy, and workability is also excellent. In addition, since the first connector and the second connector are electrically connected by the electric connection between the first terminal and the second terminal, conductivity is easily ensured, and it is possible to accurately perform supply of electricity to the external apparatus.

According to the fuse-equipped connector of the above-described configuration (2), only by detaching the second connector from the first connector, it is possible to easily access the fuse exposed from the attachment portion of the second connector, and the replacement of the fuse is smoothly performed.

According to the fuse-equipped connector of the above-described configuration (3), only by assembling the first connector and the second connector with each other, the conductive member which is exposed from the attachment portion of the second connector directly contacts the terminal of the first connector, and the first terminal and the second terminal are electrically connected to each other. For this reason, the assembly and the electric connection between the first connector and the second connector after replacing the fuse can be easily performed.

Advantageous Effects of Invention

According to the fuse-equipped connector according to the present invention, the circuit configuration of the plurality of terminals and electric wires becomes simplified, and it is possible to easily replace the fuse by detaching the second connector, and to perform an appropriate maintenance operation.

The present invention has been briefly described. Furthermore, by reading an aspect (hereinafter, referred to as an "embodiment") for carrying out the present invention which will be described below with reference to the accompanying drawings, the details of the present invention will become more apparent.

DESCRIPTION OF EMBODIMENTS

Hereinafter, an embodiment according to the present invention will be described with reference to the drawings.

Figure 1:
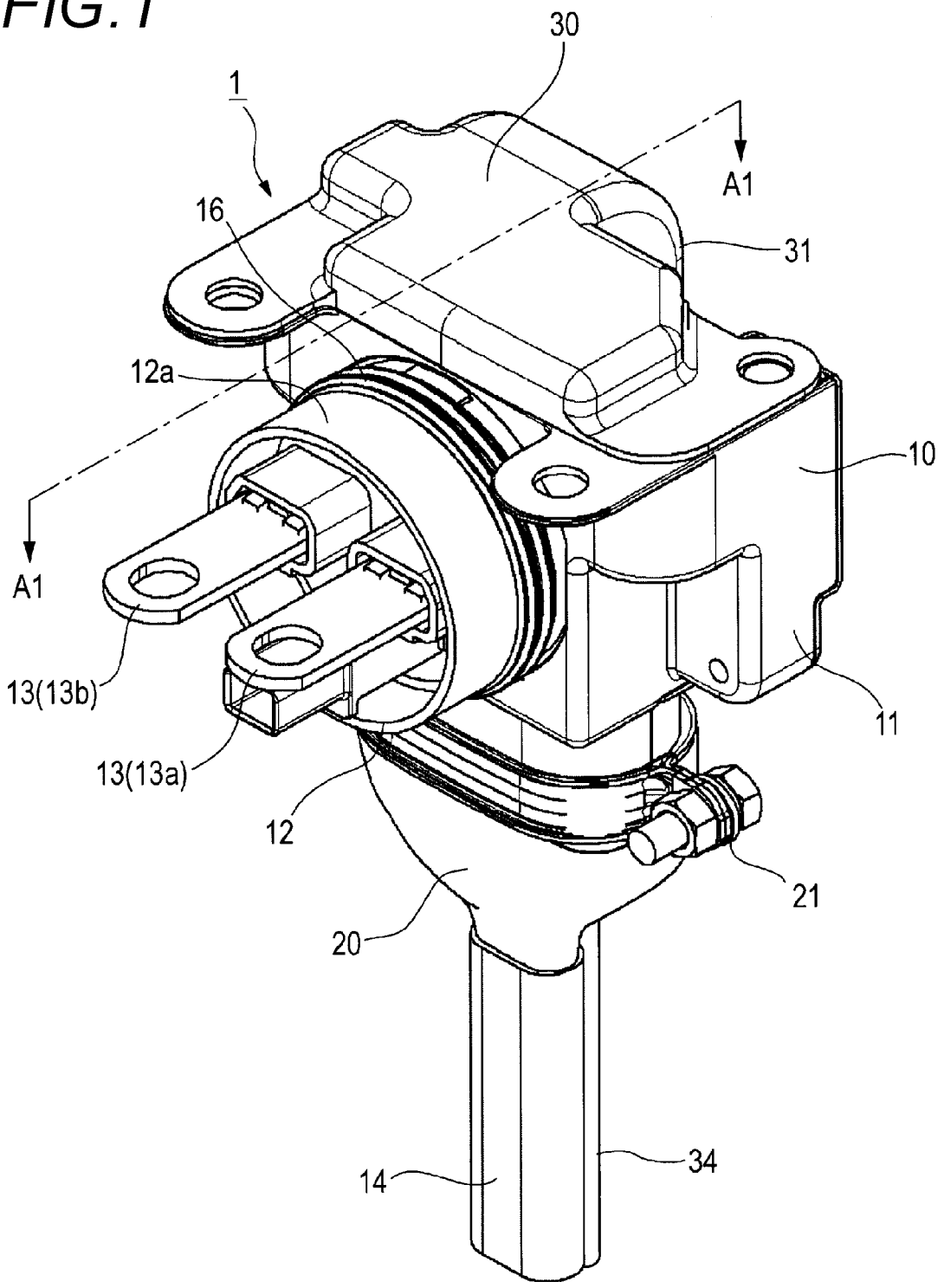
FIG. 1 is a perspective view illustrating a fuse-equipped connector according to an embodiment of the present invention.
Figure 2:
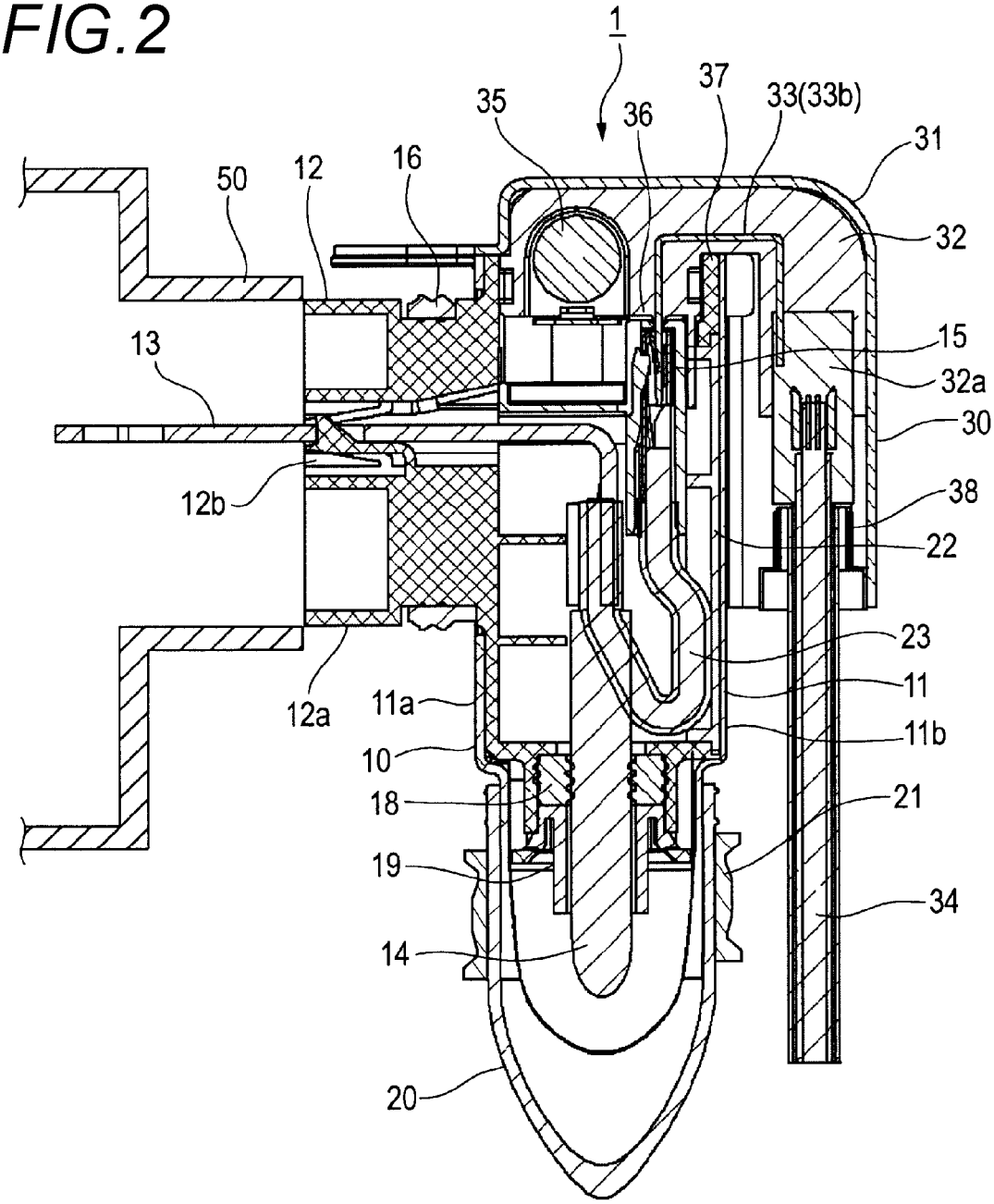
FIG. 2 is a longitudinal sectional view cut along line A1-A1 of FIG. 1, illustrating the fuse-equipped connector according to the embodiment of the present invention.
Figure 3:
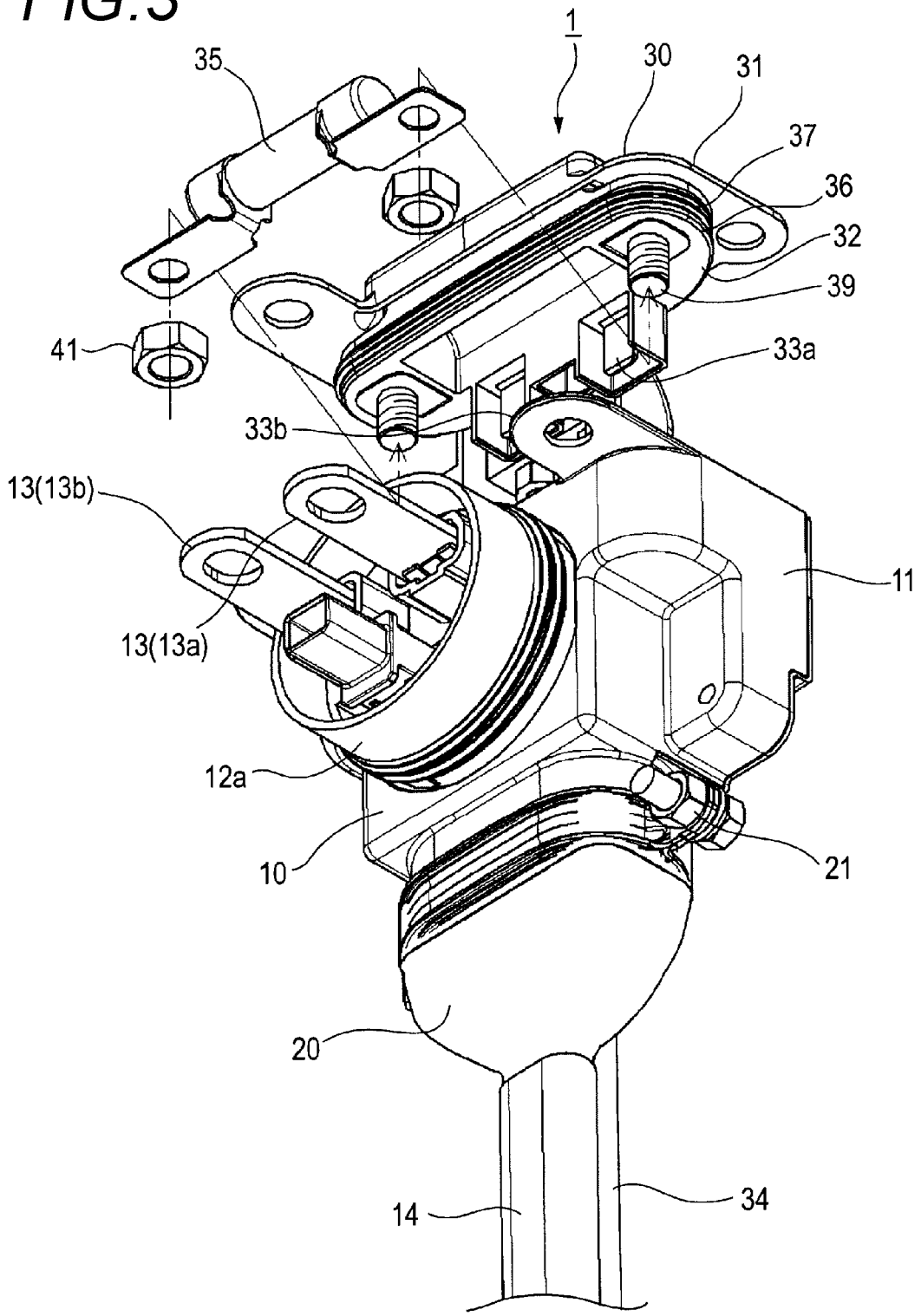
FIG. 3 is a partially exploded perspective view illustrating assembly of a first connector and a second connector in the fuse-equipped connector according to the embodiment of the present invention.

Each configuration of a fuse-equipped connector 1 according to the embodiment of the present invention will be described by using FIGS. 1 to 3.

The fuse-equipped connector 1 according to the embodiment of the present invention is attached to an external apparatus 50, such as a power control unit, which is loaded in a vehicle or the like, and is configured in combination of a first connector 10 and a second connector 30 which can be assembled to each other in an attachable and detachable state.

The first connector 10 includes a first shell 11, a first housing 12 which is disposed in a region defined by the first shell 11, a first bus bar 13 which serves as a first terminal that is fixed at a predetermined position in the first housing 12 and is electrically connected to the external apparatus 50, an input electric wire 14 which supplies electricity to the first bus bar 13, and a terminal 15 which is branched from the first bus bar 13. In addition, the first housing 12 includes a connection portion 12*a* which can be mechanically connected to the external apparatus 50.

The second connector 30 includes a second shell 31, a second housing 32 which is disposed in a region defined by the second shell 31, a second bus bar 33 which serves as a second terminal that is fixed at a predetermined position in the second housing 32, an output electric wire 34 which is a shielding electric wire that is electrically connected to the second bus bar 33, and a fuse 35 which is electrically connected to the second bus bar 33.

In addition, in a bottom portion of the second housing 32, an attachment portion 36 which is annular (oval) with respect to the first connector 10 is formed to be protruded, and the fuse 35 is fixed to the second housing 32 to be exposed from the attachment portion 36. In addition, when assembling the first connector 10 and the second connector 30 to each other, the second bus bar 33 directly contacts the terminal 15 provided in the first connector 10, and the first bus bar 13 and the second bus bar 33 are electrically connected to each other in an assembled state.

<Details of First Connector>

Figure 4:
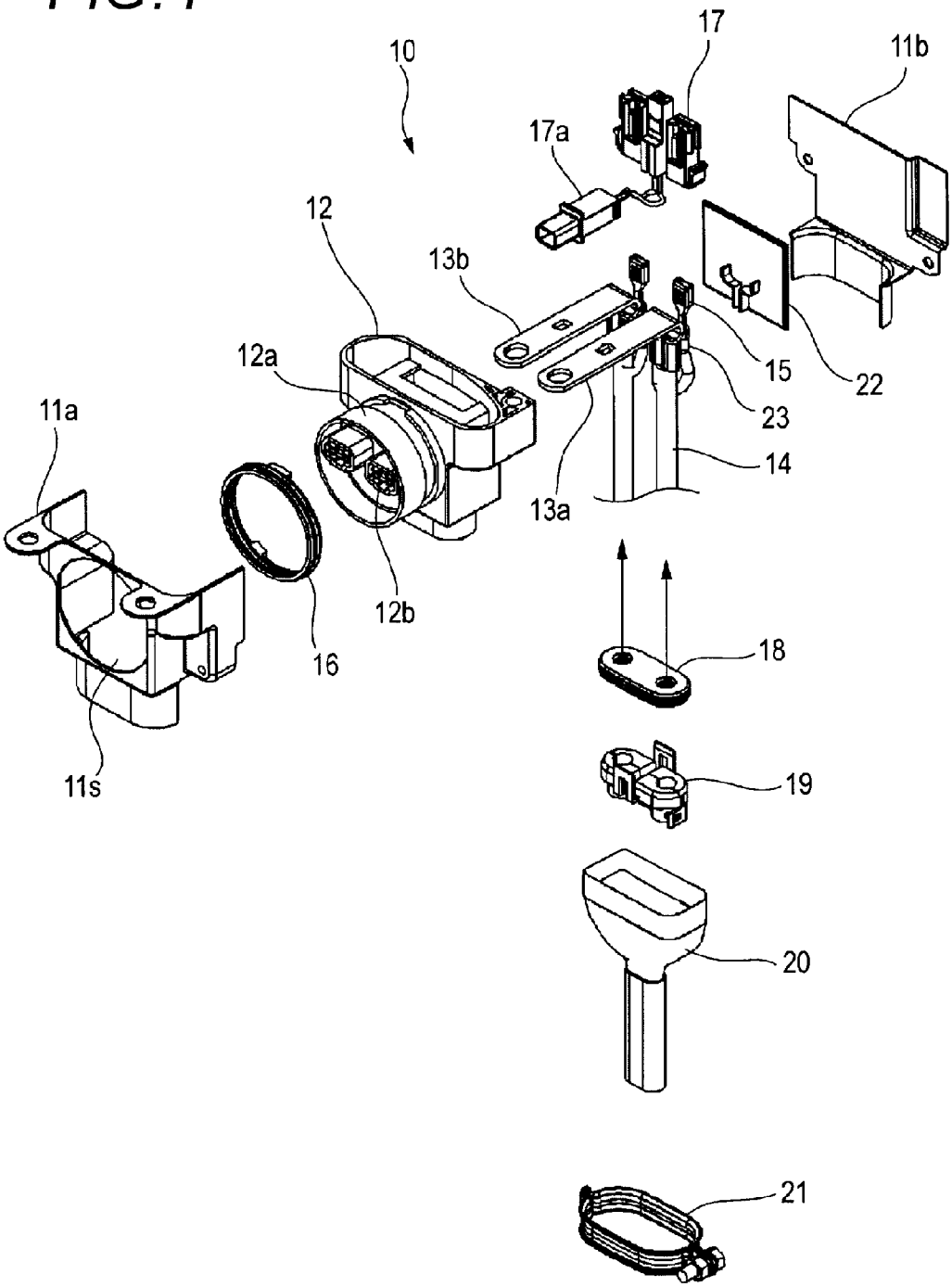
FIG. 4 is an exploded perspective view of the first connector in the fuse-equipped connector according to the embodiment of the present invention.

Details of the first connector 10 will be described by referring to FIG. 4. FIG. 4 is an exploded perspective view of the first connector 10.

In addition to the above-described configuration, the first connector 10 includes an O-ring shaped first packing 16 which is watertightly bonded to the first housing 12, a bonding portion 17 which is bonded to the terminal 15, fixes the terminal 15 at the predetermined position, and is bonded to two bus bar pieces 33*a* and 33*b* (refer to FIG. 6) of the second connector 30 which will be described later, a sheet-like mat 18 which is watertightly bonded to the input electric wire 14 as illustrated by an arrow, a braid 20 which is attached to a lower portion of the first housing 12, and covers the input electric wire 14 and an electric wire holder 19, a fixing metal fitting 21 by which the first shell 11 and the braid 20 are combined and fixed to each other, and a rear lid 22 which is fixed to a rear surface of the first housing 12.

The first shell 11 of the first connector 10 includes one pair of front shell 11*a* and a rear shell 11*b* which are made of a conductive metal which is supported and fixed by a front end portion and a rear end portion of the first housing 12. The front shell 11*a* is formed in a substantially U shape on a cross-sectional view provided with an opening portion 11*s* at the center, the rear shell 11*b* is formed in a shape of a substantially flat plate, and the front shell 11*a* and the rear shell 11*b* are combined and fixed by being assembled. Furthermore, the front portion and the rear portion are terms described by considering a left side of FIG. 3 as a front portion and a right side of FIG. 3 as a rear portion, and are not particularly limited.

The first housing 12 which is fixed in the region defined by the front shell 11*a* and the rear shell 11*b* is a molded article made of an insulating synthetic resin or the like, and includes the substantially cylindrical connection portion 12*a* and one pair of bus bar insertion holes 12*b* in which a tip end portion is protruded toward the inside of the connection portion 12*a*, and to which the first bus bar 13 is inserted. A relative positional relationship between the connection portion 12*a* and the front shell 11*a* is determined as the connection portion 12*a* passes through the opening portion 11*s* of the front shell 11*a*, and the first packing 16 is accommodated in the annular packing accommodation groove provided in an outer circumferential wall of the connection portion 12*a*. In other words, the front shell 11*a* and a front wall of the first housing 12 abut against each other, and the connection portion 12*a* is fixed in a state of being protruded from the front shell 11*a*.

The first bus bar 13 is configured of bus bar pieces 13*a* and 13*b* which serve as one pair of conductive members made of a conductive metal, one end thereof is inserted into the bus bar insertion hole 12*b*, the tip end portion thereof passes through the bus bar insertion hole 12*b* and protrudes to the front side from the connection portion 12*a*, and the other end thereof is electrically bonded to the input electric wire 14. In addition, one pair of the input electric wires 14 include branch electric wires 23 branched from the vicinity where being bonded to the first bus bar 13, and the tip end of the branch electric wire 23 is electrically combined to one pair of terminals 15.

<Example of Assembly Order of First Connector>

Each one end of the pair of first bus bars 13 is inserted into one pair of bus bar insertion holes 12*b* of the first housing 12, and is fixed at the predetermined position. Next, one pair of input electric wires 14 is electrically connected to each of the first bus bars 13. In addition, the terminal 15 and the bonding portion 17 are bonded to each other, a protrusion portion 17*a* provided in the bonding portion 17 is inserted and fixed to the connection portion 12*a* of the first housing 12, and the terminal 15 is fixed to the first housing 12 via the bonding portion 17.

The mat 18 and the electric wire holder 19 which are temporarily stopped in the vicinity of the tip end of the input electric wire 14 in advance move to the predetermined position, the rear lid 22 is fitted to the first housing 12, and the front shell 11*a* and the rear shell 11*b* are fixed. At this time, the lower end portion of the first shell 11 and the braid 20 are bonded to each other, the bonded part is fixed by the fixing metal fitting 21, and accordingly, the assembly of the first connector 10 is completed. In addition, since the assembly with the second connector 30 is possible, the upper portion of the first connector 10 is opened.

<Details of Second Connector>

Figure 5:
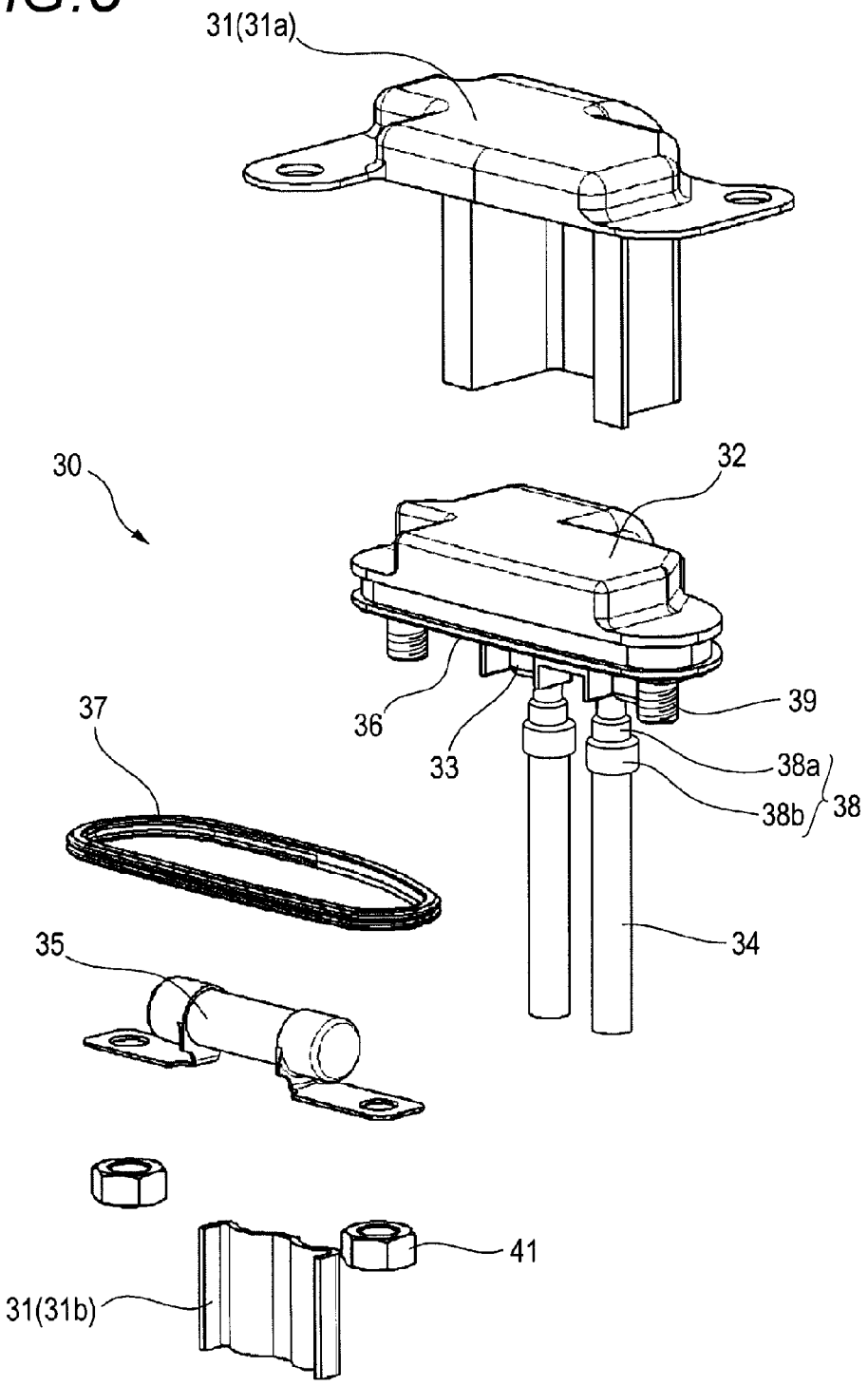
FIG. 5 is an exploded perspective view of the second connector in the fuse-equipped connector according to the embodiment of the present invention.
Figure 6:
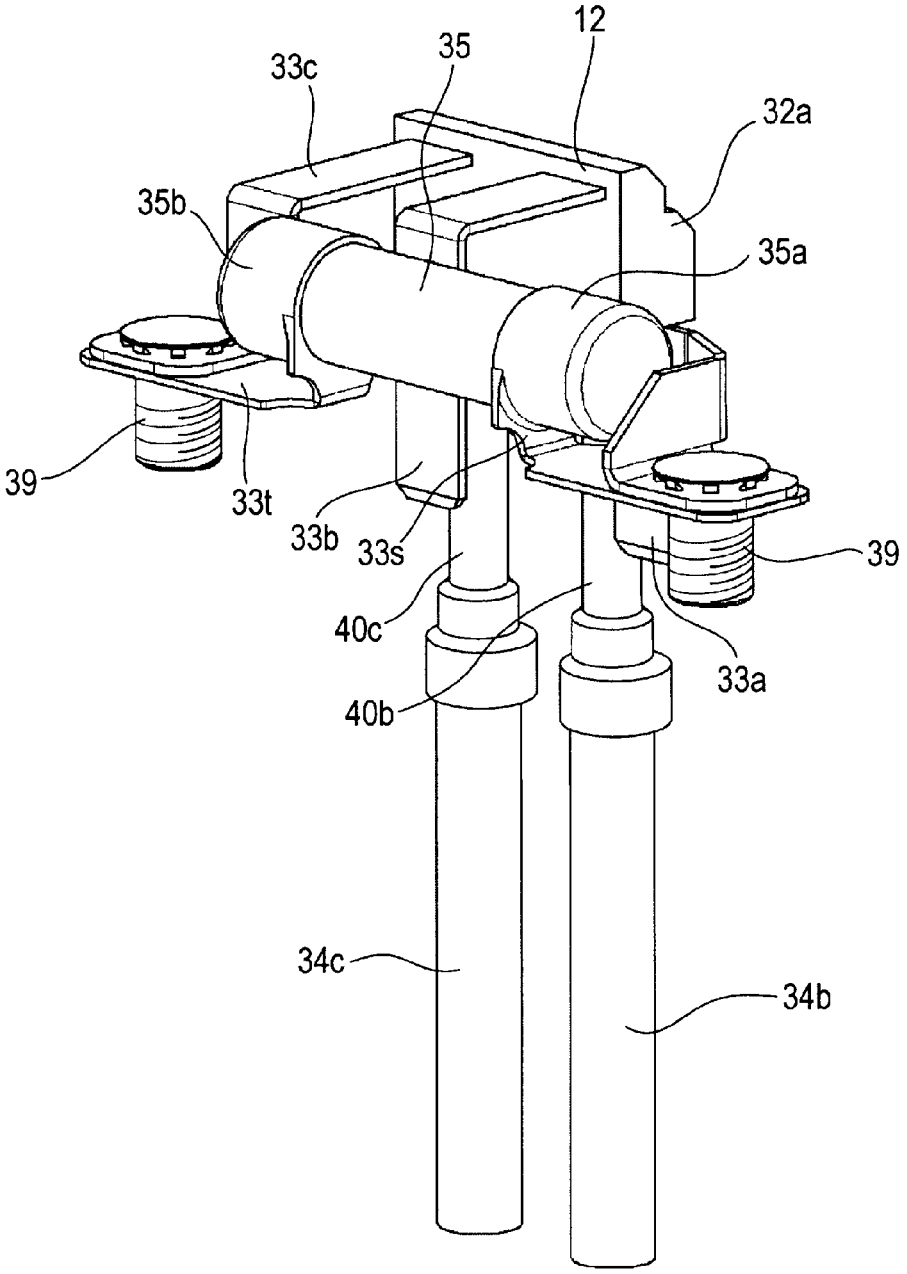
FIG. 6 is a partial perspective view of the second connector in the fuse-equipped connector according to the embodiment of the present invention.

Details of the second connector 30 will be described by using FIGS. 5 and 6. FIG. 5 is an exploded perspective view of the second connector 30, and FIG. 6 is a partial perspective view of the second connector 30.

In addition to the above-described configuration, the second connector 30 includes an O-ring shaped second packing 37 which is watertightly bonded to the second housing 32, and one pair of shielding terminals 38 which are mounted to be respectively fitted to shielding layers 40*b* and 40*c* of one pair of output electric wires 34. In addition, the shielding terminal 38 is configured of small diameter portions 38*a* having a small diameter which are respectively mounted on the shielding layers 40*b* and 40*c* and large diameter portions 38*b* having a large diameter which are adhered to an external skin.

The second shell 31 of the second connector 30 is made of a conductive metal, and includes a shell main body 31*a* put on the second housing 32, and a shell piece 31*b* fixed to a side of the shell main body 31*a*. The shell main body 31*a* is configured of a substantially box-shaped part and a substantially U-shaped part having a cross-sectional view which extends downward, the shell piece 31*b* is formed in a shape of a substantially flat plate, and the shell main body 31*a* and the shell piece 31*b* are combined and fixed to each other by assembling.

The second housing 32 which is fixed in a region defined by the shell main body 31*a* and the shell piece 31*b* is a molded article made of an insulating synthetic resin, is formed in a shape of a substantial box, and one pair of screw portions 39 are formed for attaching the fuse 35 to the bottom portion of the second housing 32 to be freely attached and detached.

The second bus bar 33 is configured of three bus bar pieces 33*a*, 33*b*, and 33*c* which serve as conductive members made of a conductive metal, and a part thereof is integrally formed with a resin sealing portion 32*a* of the second housing 32 in a sealed state. The fuse 35 includes fuse terminals 35*a* and 35*b* which protrude to both ends of the fuse 35, and is conductively connected to between one pair of connection terminals 33*s* and 33*t* provided at one end of the second bus bar 33 disposed in the attachment portion 36 to be fusible.

In the embodiment illustrated in FIG. 6, in each of the bus bar pieces 33*a*, 33*b*, and 33*c*, the bus bar piece 33*a* and the connection terminal 33*s* which are disposed on the right side in the drawing and protrude downward are combined to be integrated by the screw portion 39. Apart of the bus bar piece 33*b* which is positioned in the vicinity of the center of the resin sealing portion 32*a* and protrudes downward is sealed to the resin sealing portion 32*a*, and is electrically connected to a conductor of one output electric wire 34*b* which is exposed downward from the resin sealing portion 32*a*. In addition, the bus bar piece 33*c* which is disposed on the left side in the drawing is combined to be integrated with a connection terminal 33*t* by the screw portion 39, and a part of the bus bar piece 33*c* is sealed to the resin sealing portion 32*a*, and is electrically connected to a conductor of an output electric wire 34*c* which is exposed downward from the resin sealing portion 32*a*.

<Example of Assembly Order of Second Connector>

In the annular packing accommodation groove provided in the side portion of the second housing 32, the second packing 37 is accommodated. Next, each shielding terminal 38 is electrically connected to the shielding layers 40*b* and 40*c* exposed to the end portion of one pair of output electric wires 34 which protrude from the bottom portion of the resin sealing portion 32*a*. In addition, after the fuse 35 is engaged with the screw portion 39 and the fuse 35 is fixed at the predetermined position by a nut 41, the shell main body 31*a* is put on from the upper portion of the second housing 32, the shell piece 31*b* is fixed to the shell main body 31*a* from the side portion, and accordingly, the assembly of the second connector 30 is completed. As the shell main body 31*a* and the shell piece 31*b* are fastened, the large diameter portion 38*b* of the shielding terminal 38 is pressed, and shielding properties of the second connector 30 are achieved.

<Assembly of First Connector and Second Connector>

The second connector 30 is put on from the upper portion of the first connector 10. At this time, two bus bar pieces 33*a* and 33*b* of the second connector 30 are respectively electrically bonded to one pair of terminals 15 via the bonding portion 17. In addition, the first bus bar 13 and the second bus bar 33 are electrically connected to each other, and waterproofing properties between the first connector 10 and the second connector 30 are achieved by the second packing 37. As the first shell 11 and the second shell 31 are mechanically fastened, the assembly of the first connector 10 and the second connector 30 is completed. In addition, the fastening of the external apparatus 50 and the fuse-equipped connector 1 may be performed as the connection portion 12*a* formed in the first housing 12 is mechanically connected and fixed to the external apparatus 50.

<Replacement of Fuse>

When replacing the fuse 35, when the fitted first connector 10 and the second connector 30 are released, the fuse 35 is exposed from the attachment portion 36 of the second housing 32. For this reason, when the nut 41 is removed, one can replace the fuse 35, and inserts the bus bar pieces 33*a* and 33*b* into the terminal 15, and mechanically fasten the second connector 30 to the first connector 10 again. At this time, it is not necessary to remove the fuse-equipped connector 1 from the external apparatus 50, and it is possible to extremely easily replace the fuse 35.

Figure 7:
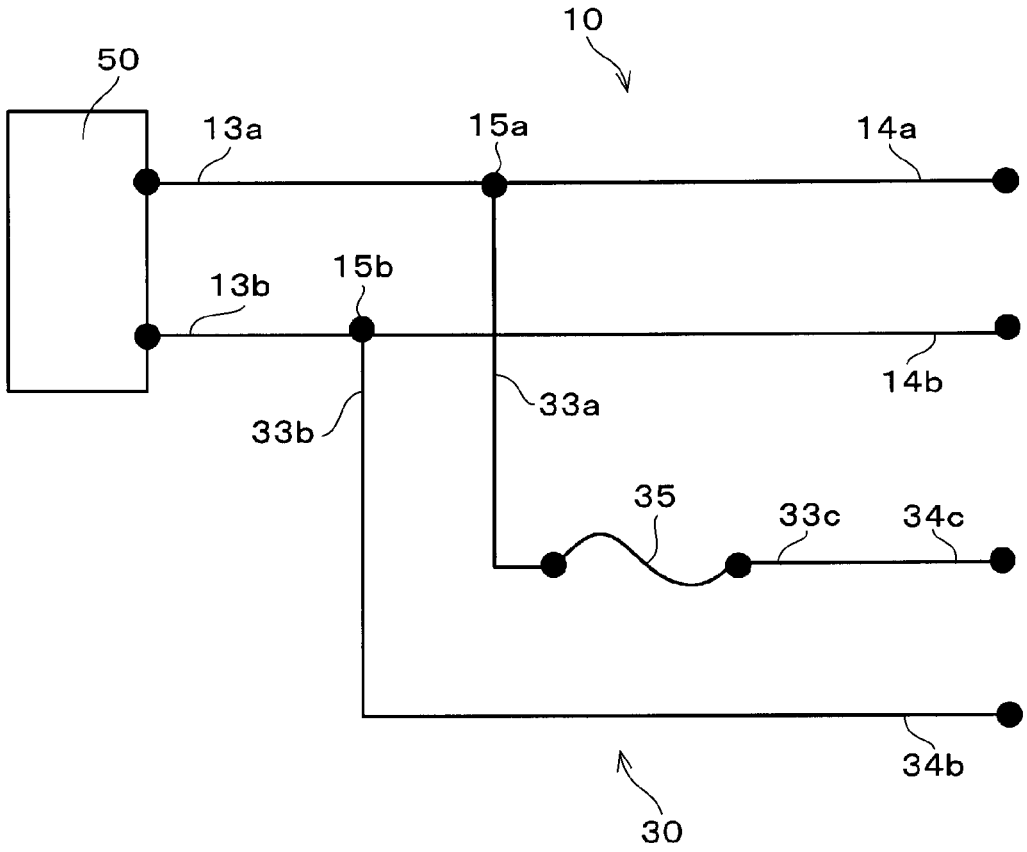
FIG. 7 is a circuit perspective view illustrating a flow of electricity in the fuse-equipped connector according to the embodiment of the present invention.
Figure 8:
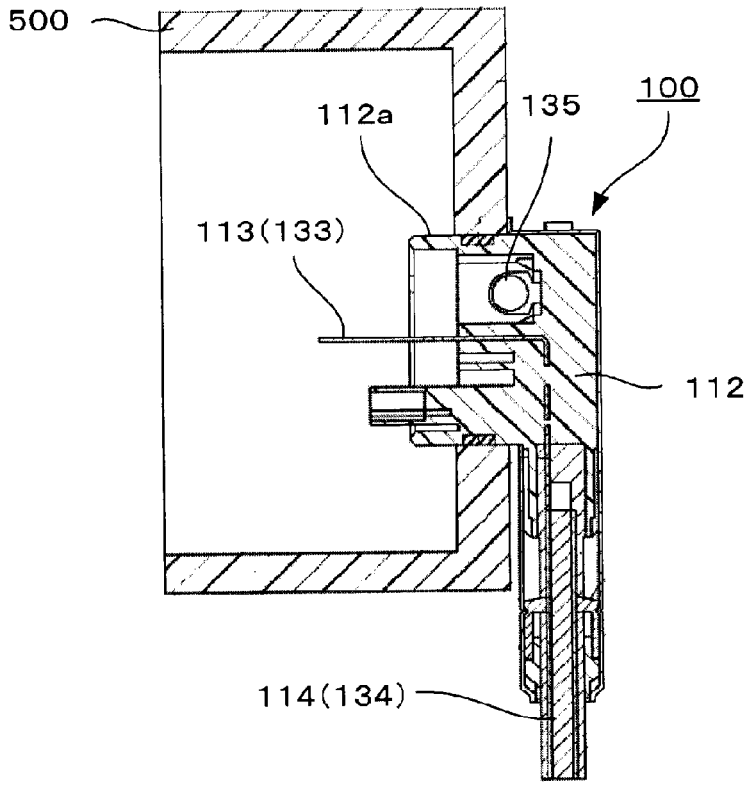
FIG.8 (Prior Art)
In FIG. 8, (*a*) and (*b*) are views illustrating an example of a fuse-equipped connector in the related art, in which FIG. 8(*a*) is a longitudinal sectional view, and FIG. 8(*b*) is a front perspective view.
Figure 8:
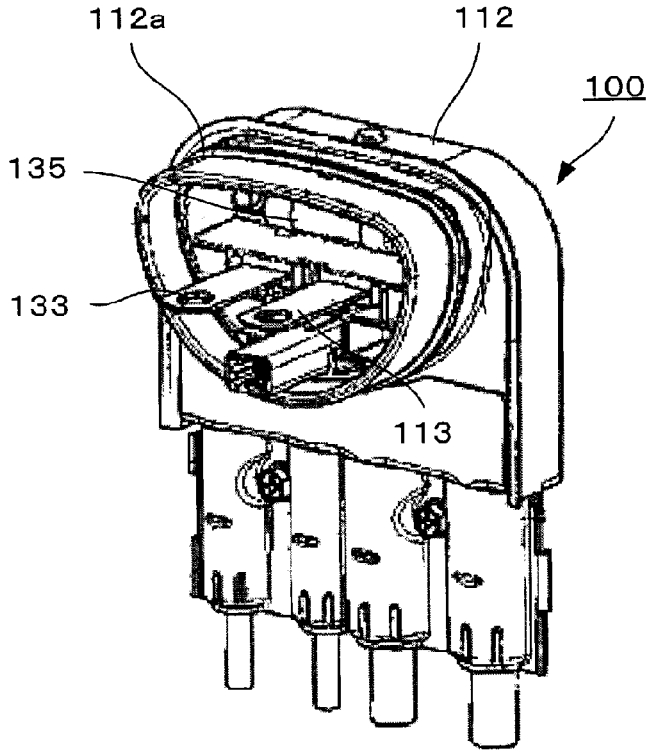
FIG.8 (Prior Art)
Figure 9:
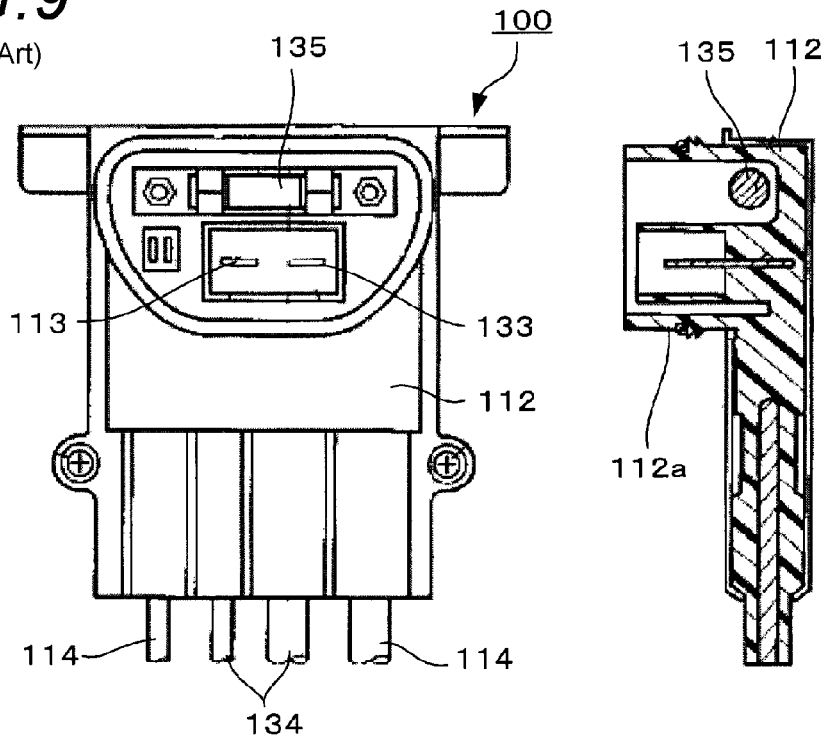
FIG.9 (Prior Art)
In FIG. 9, (*a*) and (*b*) are views illustrating another example of a fuse-equipped connector in the related art, in which FIG. 9(*a*) is a front view and a longitudinal sectional view, and FIG. 9(*b*) is an external view of a state of attachment to an external apparatus.
Figure 9:
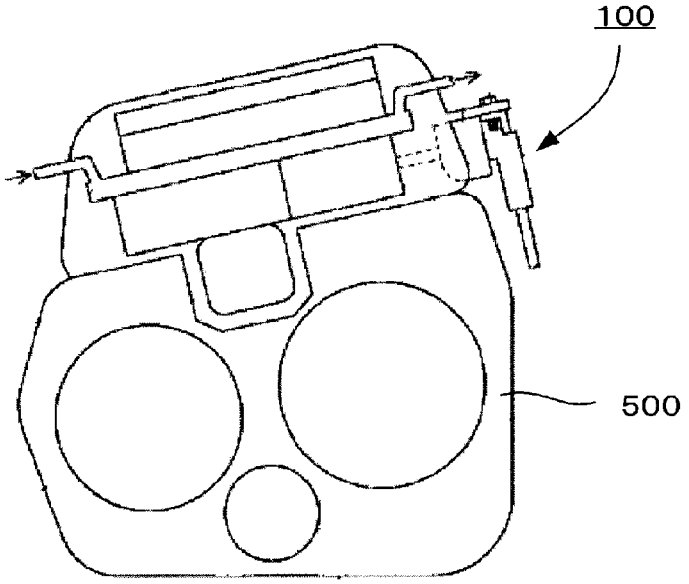
FIG.9 (Prior Art)

FIG. 7 is a circuit schematic view illustrating a flow of electricity of the fuse-equipped connector 1 according to the embodiment. In FIG. 7, one pair of input electric wires 14 of the first connector 10 are respectively considered as an input electric wire 14*a* and an input electric wire 14*b* illustrated from the right side in FIG. 4, and the terminal 15 is considered as a terminal 15*a* and a terminal 15*b*, respectively.

When the first connector 10 and the second connector 30 are electrically connected to each other, one input electric wire 14*a* of the first connector 10 is electrically connected to the bus bar piece 33*a* of the second connector 30 via the terminal 15*a*, and is electrically connected to the output electric wire 34*c* via the fuse 35 and the bus bar piece 33*c*. In addition, the input electric wire 14*b* is electrically connected to the bus bar piece 33*b* via the terminal 15*b*, and is electrically connected to the output electric wire 34*b*.

Since an input side circuit and an output side circuit can be independently configured by the first connector 10 which controls the input side and the second connector 30 which controls the output side, each maintenance operation becomes easy, and a complicated circuit configuration is not necessary. In addition, by detaching the second connector 30 from the first connector 10, it is possible to easily replace the fuse 35, and further to ensure waterproofing properties with respect to the external apparatus 50 for making it possible to replace the fuse 35 in a state where the first connector 10 and the external apparatus 50 are connected to each other. In addition, components, such as a service cover or an interlock circuit for the service cover, are not necessary, and the entire configuration also becomes simplified.

Hereinafter, the fuse-equipped connector according to an embodiment will be summarized.

(1) A fuse-equipped connector (1) according to the embodiment is configured in combination of a first connector (10) and a second connector (30), and the first connector (10) includes a first terminal (first bus bar 13) electrically connected to an external apparatus (50) and a connection portion (12*a*) mechanically connectable to the external apparatus (50), the second connector (30) includes a second terminal (second bus bar 33) electrically connected to the first terminal (first bus bar 13) and a fuse (35) being electrically connected to the second terminal (second bus bar 33), and the first connector (10) and the second connector (30) can be assembled to each other in an attachable and detachable state, and the first terminal (first bus bar 13) and the second terminal (second bus bar 33) are electrically connected to each other in an assembled state.

(2) In the fuse-equipped connector (1) according to the embodiment, the fuse (35) is exposed from an attachment portion (36) to the first connector (10) in the second connector (30) when the second connector (30) is detached from the first connector (10).

(3) In the fuse-equipped connector (1) according to the embodiment, at least one conductive member (bus bar pieces 33*a* and 33*b*) which configures the second terminal (second bus bar 33) protrudes from the attachment portion (36), and, the conductive member (bus bar pieces 33*a* and 33*b*) directly contacts at least one terminal (15) provided in the first connector (10) when the first connector (10) is assembled to the second connector (30).

In addition, in the fuse-equipped connector 1 according to the above-described embodiment, expressions, such as "first" and "second", are used (for example, the first connector 10 and the second connector 30) in the description, but the present invention is not particularly limited to the terms.

In addition, the present invention is not limited to the above-described embodiment, and can be appropriately changed or improved. In addition, the material, the shape, the dimension, the number, and the disposition location of each configuration element in the above-described embodiment are arbitrary if the present invention can be achieved, and are not particularly limited.

The present application is based on Japanese Patent Application No. 2013-217838 filed on Oct. 18, 2013, the contents of which are incorporated herein by reference.

INDUSTRIAL APPLICABILITY

A fuse-equipped connector according to the present invention is advantageous as a fuse-equipped connector in which a circuit configuration of a plurality of terminals and electric wires is simplified, a fuse can be easily replaced by detaching the second connector, and an appropriate maintenance operation can be performed.

REFERENCE SIGNS LIST

1: FUSE-EQUIPPED CONNECTOR
10: FIRST CONNECTOR
11: FIRST SHELL
12: FIRST HOUSING
12*a*: CONNECTION PORTION
13: FIRST BUS BAR (FIRST TERMINAL)
13*a*, 13*b*: BUS BAR PIECE (CONDUCTIVE MEMBER)
14: INPUT ELECTRIC WIRE
15: TERMINAL
16: FIRST PACKING
30: SECOND CONNECTOR
31: SECOND SHELL
32: SECOND HOUSING
33: SECOND BUS BAR (SECOND TERMINAL)
33*a*, 33*b*, 33*c*: BUS BAR PIECE (CONDUCTIVE MEMBER)
34: OUTPUT ELECTRIC WIRE
35: FUSE
36: ATTACHMENT PORTION
37: SECOND PACKING
50: EXTERNAL APPARATUS

The invention claimed is:

1. A fuse-equipped connector comprising:

a first connector including a first terminal configured to be electrically connected to an external apparatus, and a connection portion configured to be mechanically connected to the external apparatus, and a second connector including a second terminal electrically connected to the first terminal, and a fuse electrically connected to the second terminal, and wherein the first connector and the second connector can be assembled to each other in an attachable and detachable state, and the first terminal and the second terminal are electrically connected to each other in an assembled state, and the fuse is exposed from an attachment portion to the first connector in the second connector when the second connector is detached from the first connector.

2. The fuse-equipped connector according to claim 1, wherein at least one conductive member which configures the second terminal protrudes from the attachment portion, and the conductive member directly contacts at least one terminal provided in the first connector when the first connector is assembled to the second connector.

* * * * *